US006353799B1

(12) United States Patent
Meany et al.

(10) Patent No.: US 6,353,799 B1
(45) Date of Patent: Mar. 5, 2002

(54) METHOD AND APPARATUS FOR DETERMINING POTENTIAL INTERFACIAL SEVERITY FOR A FORMATION

(75) Inventors: Nigel Charles Meany, Banchory; David Alexander Curry, Stonehaven, both of (GB); Leroy William Ledgerwood, III, Cypress, TX (US); Craig Hodges Cooley, South Ogden, UT (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/511,618

(22) Filed: Feb. 23, 2000

Related U.S. Application Data

(60) Provisional application No. 60/121,345, filed on Feb. 24, 1999.

(51) Int. Cl.[7] ..... G06F 19/00

(52) U.S. Cl. ..... 702/9; 702/11

(58) Field of Search ..... 702/9, 11, 12, 702/13, 16, 7, 8; 173/6; 703/10; 367/73; 73/152.03, 152.05; 175/24, 26, 50, 48

(56) References Cited

U.S. PATENT DOCUMENTS

| | | | | |
|---|---|---|---|---|
| 4,507,735 A | | 3/1985 | Moorhead | 364/422 |
| 4,852,399 A | | 8/1989 | Falconer | 73/151.5 |
| 4,914,591 A | | 4/1990 | Warren et al. | 364/422 |
| 4,926,686 A | | 5/1990 | Fay | 73/151 |
| 4,928,521 A | | 5/1990 | Jardine | 73/151 |
| 5,181,172 A | | 1/1993 | Whitten | 364/422 |
| 5,216,917 A | | 6/1993 | Detournay | 73/151 |
| 5,305,836 A | | 4/1994 | Holbrook et al. | 175/39 |
| 5,415,030 A | | 5/1995 | Jogi | 73/151 |
| 5,416,697 A | | 5/1995 | Goodman | 364/422 |
| 5,637,795 A | | 6/1997 | Hale et al. | 73/152.01 |
| 5,660,239 A | | 8/1997 | Mueller | 175/61 |
| 5,730,234 A | | 3/1998 | Putot | 175/50 |
| 5,787,022 A | | 7/1998 | Tibbitts et al. | 364/578 |
| 5,794,720 A | | 8/1998 | Smith et al. | 175/40 |
| 5,842,149 A | | 11/1998 | Harrell | 702/9 |
| 6,021,377 A | * | 2/2000 | Dubinsky et al. | 702/9 |
| 6,109,368 A | * | 8/2000 | Goldman et al. | 702/9 |

OTHER PUBLICATIONS

W. Soemodihardjo and S. Rachmat, "Application of an Expert System to Rotary Drilling Bit Selection," 1991.

* cited by examiner

*Primary Examiner*—Donald E. McElheny, Jr.
(74) *Attorney, Agent, or Firm*—Melvin A. Hunn

(57) ABSTRACT

A method and apparatus are provided for generating an indicator of potential for abrupt changes in rock strength in a particular wellbore. Forensic wellbore data is obtained from at least one previously drilled wellbore which is determined to be comparable to the target wellbore. An interfacial severity computer program is provided. The program consists of executable program instructions. It is adapted to utilize a plurality of wellbore parameters, including at least one forensic wellbore data element. The interfacial severity computer program is loaded onto a data processing system. At least the forensic wellbore data, and possibly other wellbore parameter data elements, are supplied as an input to the interfacial severity computer program. The data processing system is utilized to execute program instructions of the interfacial severity computer program. This applies the inputs to the interfacial severity computer program which produces an output and indicator of the potential for abrupt changes in rock strength in the particular target wellbore.

17 Claims, 5 Drawing Sheets

METHOD AND APPARATUS FOR DETERMINING POTENTIAL INTERFACIAL SEVERITY FOR A FORMATION

This application claims the benefit of U.S. Provisional Application Serial No. 60/121,345, filed Feb. 24, 1999, entitled Method and Apparatus for Determining Potential Interfacial Severity for a Formation.

BACKGROUND OF THE INVENTION

1. Field of the Invention

The present invention relates in general to computer implemented processes for improving drilling operations, and in particular to a system and method for facilitating the selection and use of drill bits by anticipating or predicting the potential occurrence of undesirable geographic conditions.

2. Description of the Prior Art

Interfacial severity is an undesirable geologic condition which impedes drilling operations. In general, drilling operations are performed in a manner which compensate for the occurrence of interfacial severity. One factor which can be controlled is the selection of particular drill bits from a group of available drill bits. Certain bits may operate better under high interfacial severity drilling conditions, while other bits are more prone to damage under high interfacial severity drilling conditions.

SUMMARY OF THE INVENTION

It is one objective of the present invention to provide a new system, method, and apparatus for providing an indicator of potential interfacial severity in a particular wellbore, which utilizes an inference engine computer program which consists of executable instructions, and which is adapted to utilize a plurality of wellbore parameters as inputs, and which produces an indicator of potential interfacial severity. It is another objective of the present invention to provide such an indicator which may be utilized in selecting particular drill bits for use in a particular wellbore.

These and other objectives are achieved as is now described. A method and apparatus are provided for generating an indicator of potential for abrupt changes in rock strength in a particular wellbore. Forensic wellbore data is obtained from at least one previously drilled wellbore which is determined to be comparable to the target wellbore. An interfacial severity computer program is provided. The program consists of executable program instructions. It is adapted to utilize a plurality of wellbore parameters, including at least one forensic wellbore data element. The interfacial severity computer program is loaded onto a data processing system. At least the forensic wellbore data, and possibly other wellbore parameter data elements, are supplied as an input to the interfacial severity computer program. The data processing system is utilized to execute program instructions of the interfacial severity computer program. This applies the inputs to the interfacial severity computer program which produces as an output an indicator of the potential for abrupt changes in rock strength in the particular target wellbore.

The above as well as additional objectives, features, and advantages will become apparent in the following description.

BRIEF DESCRIPTION OF THE DRAWINGS

The novel features believed characteristic of the invention are set forth in the appended claims. The invention itself however, as well as a preferred mode of use, further objectives and advantages thereof, will best be understood by reference to the following detailed description of the preferred embodiment when read in conjunction with the accompanying drawings, wherein:

DETAILED DESCRIPTION OF THE INVENTION

Figure 1:
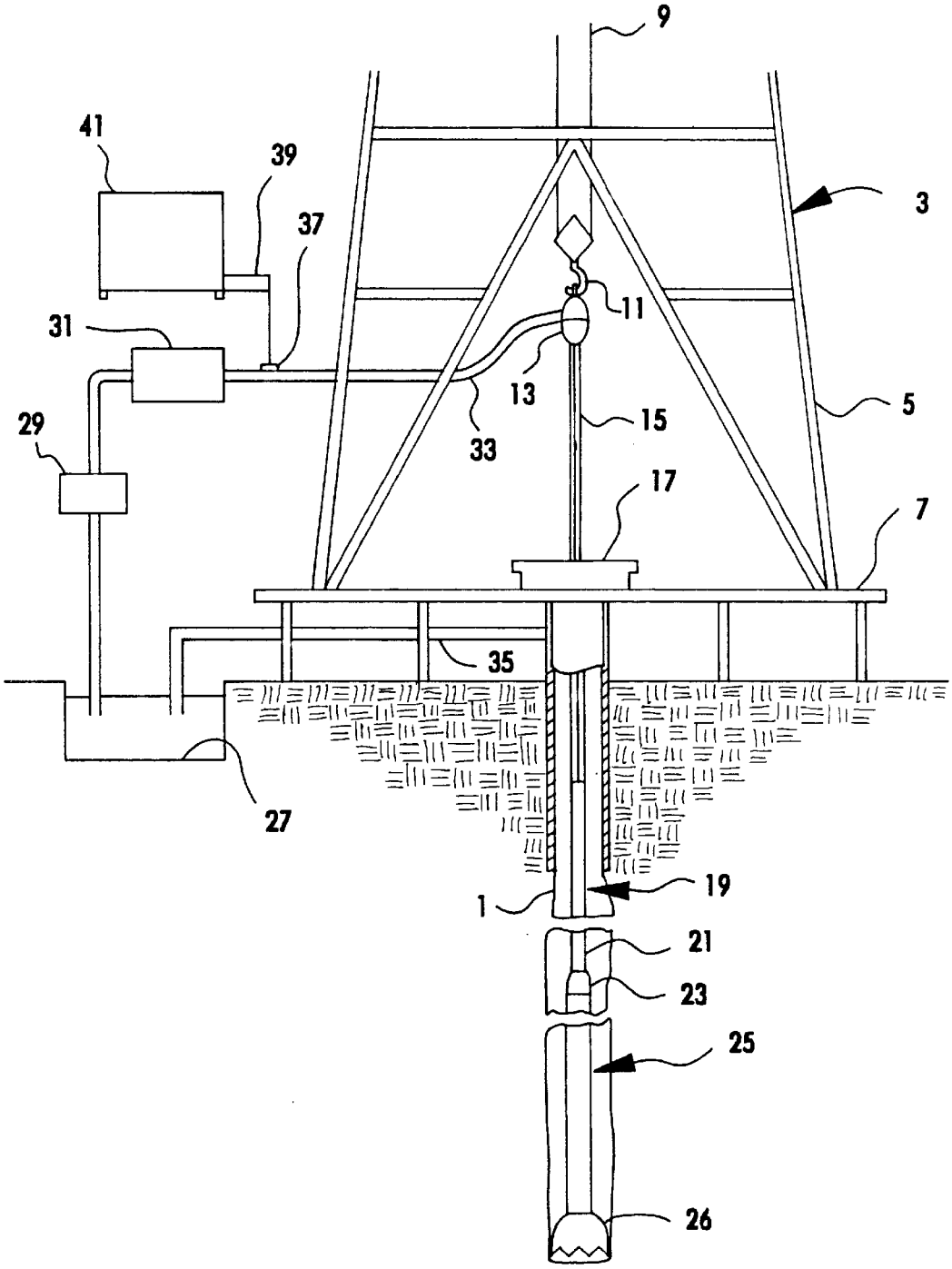
FIG. 1 is a simplified pictorial representation of drilling operations which may be conducted in accordance with the present invention.

OVERVIEW OF DRILLING OPERATIONS:

FIG. 1 depicts one example of drilling operations conducted in accordance with the present invention with a downhole drill bit selected in accordance with the present invention based upon its suitability for the drilling conditions based at least in part upon its compatibility to a projected or anticipated potential interfacial severity as determined by an interfacial severity.

As is shown, a conventional rig 3 includes a derrick 5, derrick floor 7, draw works 9, hook 11, swivel 13, kelly joint 15, and rotary table 17. A drillstring 19 which includes drill pipe section 21 and drill collar section 23 extends downward from rig 3 into wellbore 1. Drill collar section 23 preferably includes a number of tubular drill collar members which connect together, including a measurement-while-drilling logging subassembly and cooperating mud pulse telemetry data transmission subassembly, which are collectively referred to hereinafter as "measurement and communication system 25".

During drilling operations, drilling fluid is circulated from mud pit 27 through mud pump 29, through a desurger 31, and through mud supply line 33 into swivel 13. The drilling mud flows through the kelly joint and an axial central bore in the drillstring. Eventually, it exits through jets which are located in downhole drill bit 26 which is connected to the lowermost portion of measurement and communication system 25. The drilling mud flows back up through the annular space between the outer surface of the drillstring and the inner surface of wellbore 1, to be circulated to the surface where it is returned to mud pit 27 through mud return line 35. A shaker screen (which is not shown) separates formation cuttings from the drilling mud before it returns to mud pit 27.

Preferably, measurement and communication system 25 utilizes a mud pulse telemetry technique to communicate data from a downhole location to the surface while drilling operations take place. To receive data at the surface, transducer 37 is provided in communication with mud supply line 33. This transducer generates electrical signals in response to drilling mud pressure variations. These electrical signals are transmitted by a surface conductor 39 to a surface electronic processing system 41, which is preferably a data processing system with a central processing unit for executing program instructions, and for responding to user commands entered through either a keyboard or a graphical pointing device.

The mud pulse telemetry system is provided for communicating data to the surface concerning numerous downhole conditions sensed by well logging transducers or measurement systems that are ordinarily located within measurement and communication system 25. Mud pulses that define the data propagated to the surface are produced by equipment which is located within measurement and communication system 25. Such equipment typically comprises a pressure pulse generator operating under control of electronics contained in an instrument housing to allow drilling mud to vent through an orifice extending through the drill collar wall. Each time the pressure pulse generator causes such venting, a negative pressure pulse is transmitted to be received by surface transducer 37. An alternative conventional arrangement generates and transmits positive pressure pulses. As is conventional, the circulating mud provides a source of energy for a turbine-driven generator subassembly which is located within measurement and communication system 25. The turbine-driven generator generates electrical power for the pressure pulse generator and for various circuits including those circuits which form the operational components of the measurement-while-drilling tools. As an alternative or supplemental source of electrical power, batteries may be provided, particularly as a back-up for the turbine-driven generator.

Figure 2:
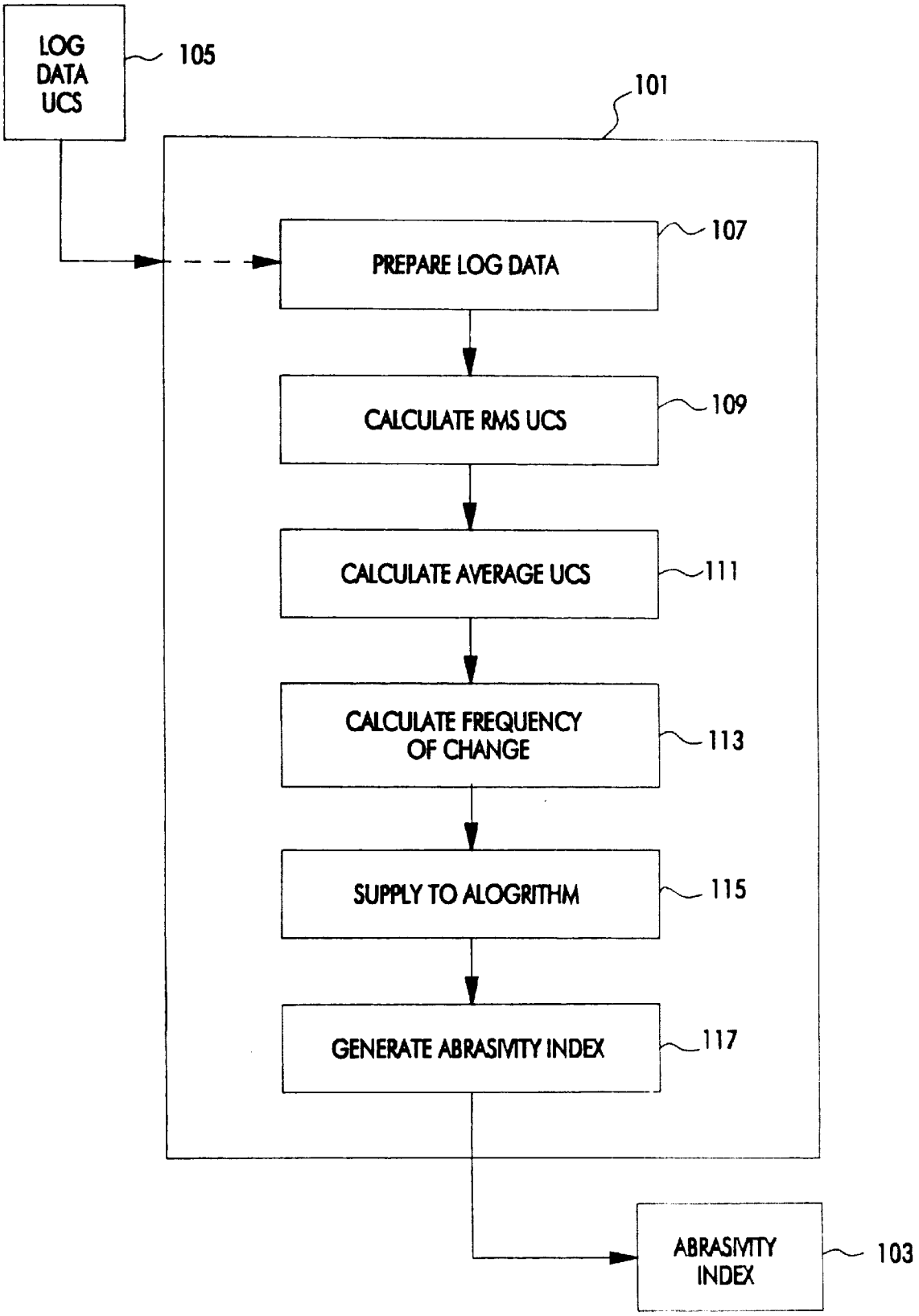
FIG. 2 is a block diagram representation of the general operations performed in the computer program in accordance with the preferred embodiment of the present invention.

FIG. 2 is a block diagram pictorial representation of the broad concept of the present invention. As is shown, an inference engine 101 produces as an output 103 an 24 indicator of potential interfacial severity. Input 105 is provided to the inference engine 101. In the preferred embodiment of the present invention, unconfined compressive strength forensic log data from offset wells is provided as one input. These wells are located proximate to the target well, and likely traverse geologic formations at particular depths. The target well is expected to traverse the same types of formations at generally the same types of depths. Therefore, the offset wells provide a good indication of the lithology that is going to be drilled in the target well. In the preferred embodiment of the present invention, this data is used in the planning stages of the target wellbore in order to select the types of bits which are more suitable for particular drilling conditions which have a greater suitability for anticipated interfacial severity conditions. In other words, the inference engine 101 is utilized in well planning operations in order to select particular bits which might perform better under projected conditions.

As is shown in the view of FIG. 2, the inference engine 101 includes a predetermined series of operations. In accordance with step 107, the log data is prepared. This is done by generating values for particular depth increments (preferably one-half foot increments). In other words, the analog log data of unconfined compressive strength is digitized so that the log data is represented by a data array with each data element representing a value for a one-half foot (or other predetermined) section of depth. Next, in accordance with step 109, the RMS value of unconfined compressive strength is calculated. Then, in accordance with step 111, the average unconfined compressive strength is calculated. Then, in accordance with block 113, the frequency of change is calculated. All of these calculations (for steps 109, 111, 113) are done for each ten foot window of log data. In other words, twenty data elements are utilized to generate a ten foot window of log data. This information is supplied to the algorithm, in accordance with block 115, and the algorithm generates an interfacial severity index in accordance with step 117. The interfacial severity 103 is supplied as an output from inference engine 101.

The inference engine 101 of FIG. 2 is preferably constructed utilizing executable program instructions. Preferably, the program instructions are executed by a general purpose data processing system, such as that depicted in FIG. 3.

Figure 3:
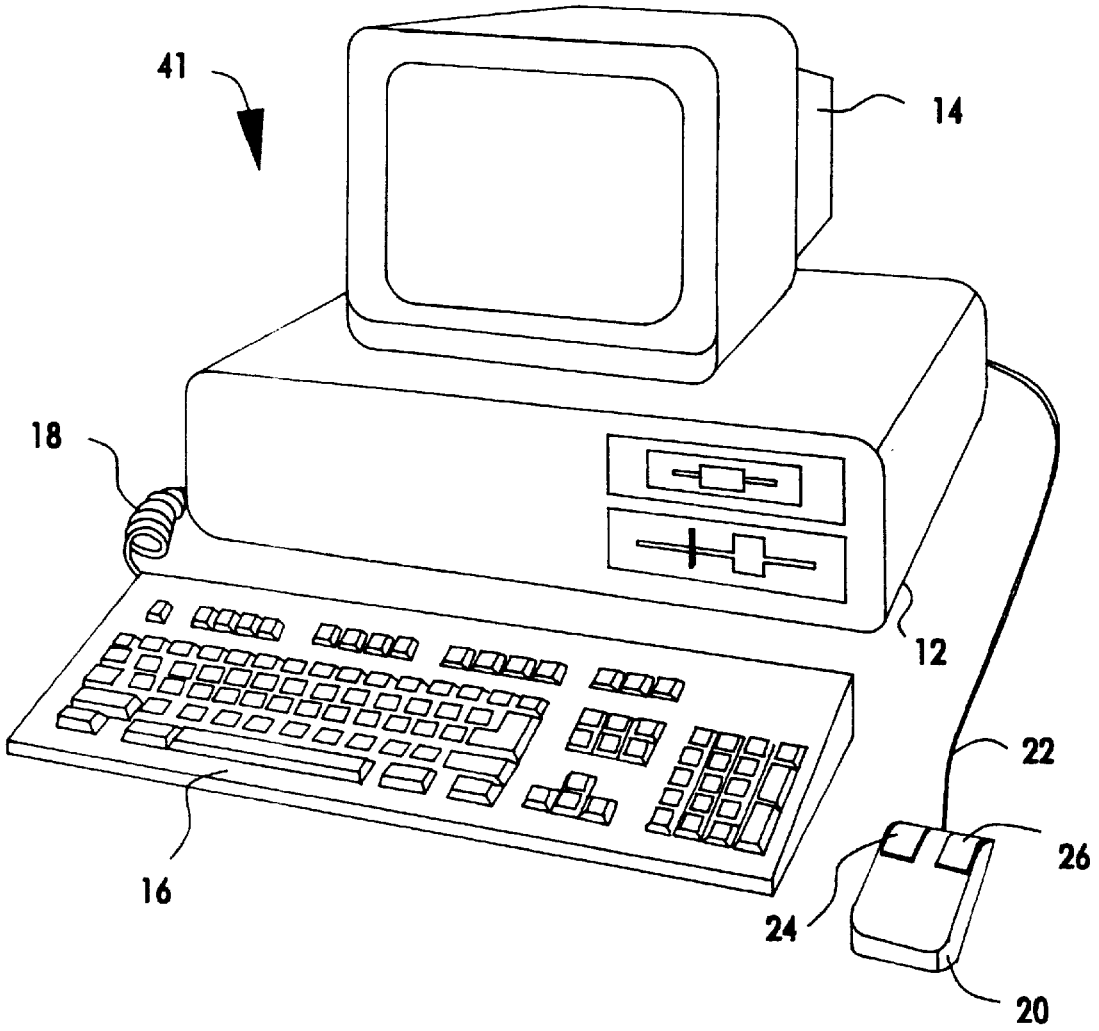
FIG. 3 is a pictorial representation of a data processing system.

With reference now to the figures and in particular with reference to FIG. 3, there is depicted a pictorial representation of data processing system 41 which may be programmed in accordance with the present invention. As may be seen, data processing system 41 includes processor 12 which preferably includes a graphics processor, memory device and central processor (not shown). Coupled to processor 12 is video display 14 which may be implemented utilizing either a color or monochromatic monitor, in a manner well known in the art. Also coupled to processor 12 is keyboard 16. Keyboard 16 preferably comprises a standard computer keyboard which is coupled to the processor by means of cable 18.

Also coupled to processor 12 is a graphical pointing device, such as mouse 20. Mouse 20 is coupled to processor 12, in a manner well known in the art, via cable 22. As is shown, mouse 20 may include left button 24, and right button 26, each of which may be depressed, or "clicked", to provide command and control signals to data processing system 41. While the disclosed embodiment of the present invention utilizes a mouse, those skilled in the art will appreciate that any graphical pointing device such as a light pen or touch sensitive screen may be utilized to implement the method and apparatus of the present invention. Upon reference to the foregoing, those skilled in the art will appreciate that data processing system 41 may be implemented utilizing a so-called personal computer.

In accordance with the preferred embodiment of the present invention, the inference engine 101 (of FIG. 2) is constructed of executable instructions which are executed by a data processing system 41. What follows is a discussion of interfacial severity, the interfacial severity index which is generated in accordance with the present invention, a discussion of application of the interfacial severity index to one test well, and a discussion of the contents of the computer implemented inference engine 101 of FIG. 2.

INTERFACIAL SEVERITY

Rocks in the earth are generally oriented in layers. Damage may occur to a rock bit when it drills across an interface, from a rock layer of one strength into a rock layer of another strength. For example when a bit drills from a weak rock layer into a strong rock layer, there are instances in which the leading portion of the bit is drilling the strong layer while the trailing portion of the bit is still drilling the soft rock. In this instance, the majority of the bit weight (the force applied to the bit to cause it to drill) may be concentrated on the few cutters which are in the hard rock. Similar overloading of cutters may occur when drilling from a hard into a soft rock. Also, the rate of penetration (ROP) of bits is typically higher in soft rocks than in hard rocks. If a bit is drilling at a high ROP through soft rock encounters a hard interface, the cutters on the leading portions of the bit must also assume the job of decelerating the drill string. Finally, drilling from one layer into another can aggravate adverse bit dynamics and cause cutter damage. The severity of these changes in rock interface depends on the magnitude of the change from one interface to the next and the frequency with which new rock interfaces are encountered. The magnitude of the challenge that changes in rock interfaces pose to a bit is called "interfacial severity." Colloquially, formations which have a high interfacial severity are said to be "atty."

The goal of this work was to provide an index that ranges from "0" to "1" and that corresponds to the interfacial severity of a given formation. This index was to be derived from wire line data that is readily available.

An interfacial severity of "0" would correspond to no interfacial severity (a homogeneous rock) and "1" to a very severe interfacial severity. Values above 0.5 would be deemed to be problematic.

METHOD EMPLOYED IN DEVELOPING AN INTERFACIAL SEVERITY INDEX

The way that we have quantified interfacial severity, in this first embodiment, does not represent simply the magnitude of the change from one rock strata to the next. The interfacial severity index for a given depth is a measure of how much change there is in rock strength between the depth of interest and rocks nearby. That is, not defined at a point, but over an interval.

Conceptually there are at least three factors which must be considered when quantifying the interfacial severity index over an interval. An obvious factor is the relative magnitude of the change in rock strength from one stratum to the next. Large relative changes in strength are worse than small ones. A second factor is the magnitude of rock strength of the each of the rocks forming an interface. If the rock strength of both rocks is very low, then changes in rock strength are of little consequence, even though the percentage change across the interface might be high. It is only when the rock strength is high in at least one of the interfaces that interfacial severity becomes an issue. Finally, the frequency with which the changes occur over an interval is also a factor in determining the magnitude of the interfacial severity.

The algorithm of the preferred embodiment quantifies interfacial severity as follows. At every depth, a window of investigation ten feet in length is defined (five feet before the depth and five feet ahead of the depth). Each of the factors described above could be quantified in a multitude of ways. We have chosen to quantify them as follows. First, measure of the amount of change in rock strength is obtained by computing the RMS average (the "root mean square" value) of all the rock strengths in the window. Second, a measure of the magnitude of the rock strength in the window is determined by averaging all of the rock strengths in the window. Finally, measure of the frequency with which the rock strength changes is determined by summing the magnitude of all instances of change in rock strength, in which the change crosses a line defined by the average rock strength (number of times the strength signal curve goes from positive to negative or vise versa). This last term is referred to as "SSCD," which stands for Sum of the Sign Change Deltas. All of these terms have units of rock strength (psi in this case).

These three terms are then combined simply by multiplying them together and dividing by a large constant. The constant is a scaling factor; its magnitude is chosen such that rocks which are known to be "ratty," have an index of 0.5 or larger.

$$(\text{Avg UCS})*(\text{RMS Average of UCS})*(\text{SSCD})/\mathbf{30\times10^{11}}$$

CREATION OF 10' WINDOW WITH 0.5 FOOT INCREMENTS:

The subroutine needs data in 0.5 foot increments. Before it does anything, it calls a subroutine which extracts a 10' window of data around the depth of interest and converts the data into 0.5 foot increments if necessary.

Figure 5:
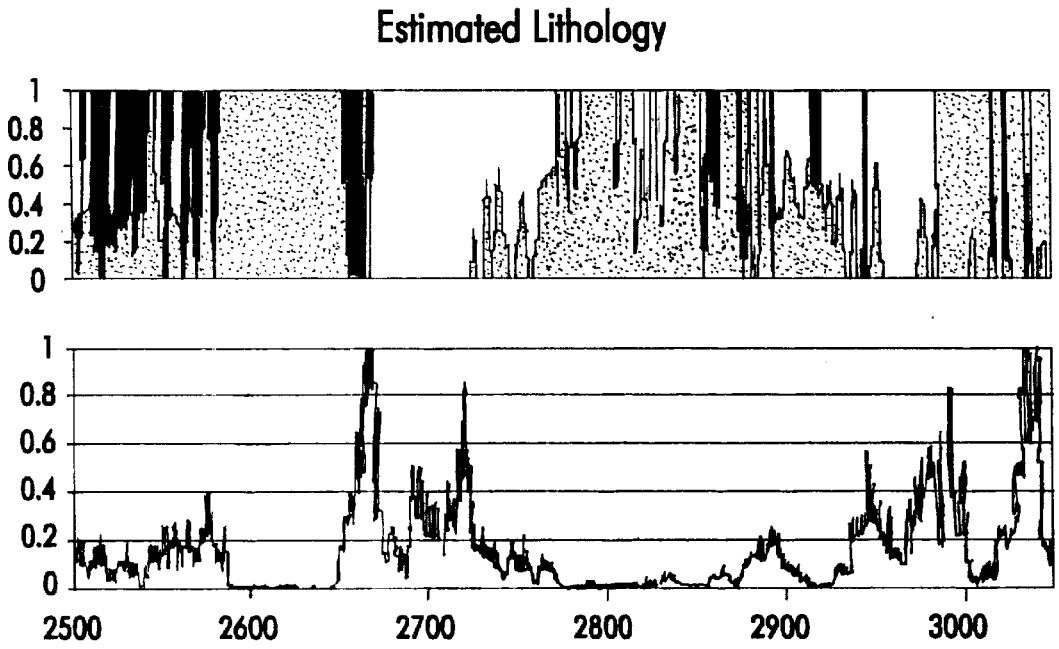
FIG. 5 is a graphical representation of a beta test of the computer program of the present invention.

EXAMPLE WELL BAKER HUGHES EXPERIMENTAL TEST AREA (RETA), BEGGS OKLAHOMA:

The program of the present invention was run on BETA data as an example on logs taken from the BETA test site. The graph of FIG. 5 shows the resulting interfacial severity index for 2500 to 3050 feet depth. The lithology is shown in the top track. The bottom track shows the interfacial severity index. Note, for example, that in the Woodford Shale from 2580' to 2650', the interfacial severity is essentially zero. In this region the overall rock strength and the changes in rock strength is relatively low. However, between about 2650 and 2670 several short and hard stringers in the Misener Sandstone, Viola Limestone and Viola Dolomite leading into the Wilcox Sandstone. There are significant changes in unconfined compressive strength through this section which come in rapid succession. The interfacial severity index rises dramatically and reaches the maximum of 1. The interfacial severity through the Wilcox itself, from about 2670 to 2760 is generally moderate. The interfacial severity rises to high values again between about 3030 and 3050 feet in the Arbuckle Dolomite.

Figure 4:
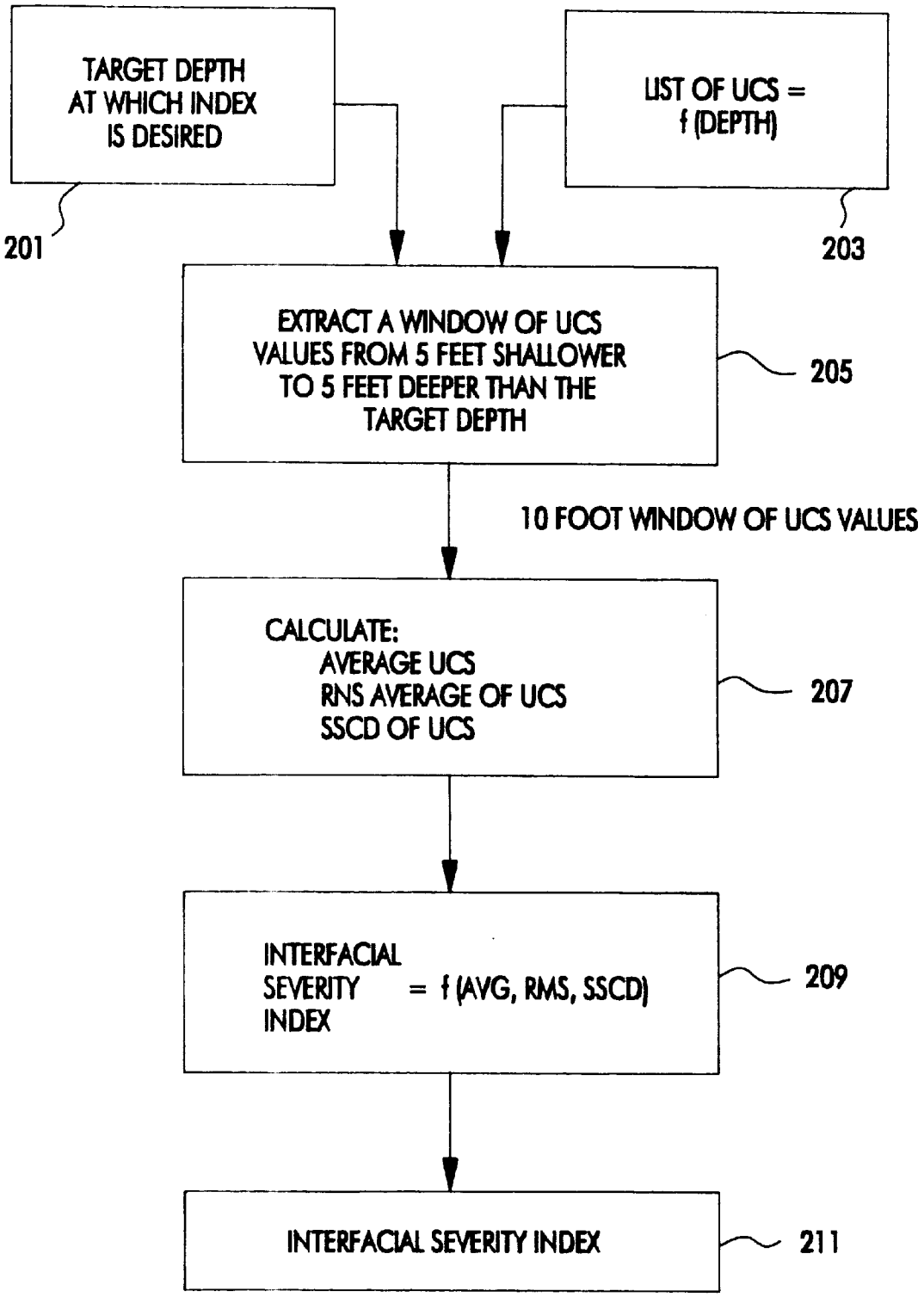
FIG. 4 is a flowchart representation of the data processing implemented steps of the preferred embodiment of the present invention.

FIG. 4 is a flowchart representation of the computer executable instructions which compose the preferred embodiment of the present invention. Two inputs are provided to the computer program including inputs 201, 203. Input 201 is the target depth at which the index is desired. Input 203 is a list of the unconfined compressive strength in the depth range of interest. These inputs are provided to software block 205, which extracts a window of unconfined compressive strength values from five feet shallower to five feet deeper than the target depth. After the ten foot window is constructed, control passes to block 207, wherein the program calculates the average unconfined compressive strength for that interval, the root mean square average of the unconfined compressive strength for that interval, and the frequency of change (the SSCD) of the unconfined compressive strength. Next, control passes to block 209, wherein the interfacial severity index is calculated as a function of the average, the root mean square average, and the frequency of change. In accordance with block 211, the interfacial severity index is provided as an output at block 211.

Although the invention has been described with reference to a particular embodiment, this description is not meant to be construed in a limiting sense. Various modifications of the disclosed embodiments as well as alternative embodiments of the invention will become apparent to persons skilled in the art upon reference to the description of the invention. It is therefore contemplated that the appended clams will cover any such modifications or embodiments that fall within the scope of the invention.

What is claimed:

1. A method of providing an indicator of potential for abrupt changes in rock strength in a particular wellbore, comprising:

(a) obtaining forensic wellbore data from at least one previously drilled wellbore which is determined to be comparable to said particular wellbore;

(b) providing an interfacial severity computer program consisting of executable program instructions, and adapted to utilize said forensic wellbore data;

(c) loading said interfacial severity computer program on to a data processing system;

(d) supplying as an input to said interfacial severity computer program said forensic wellbore data; and (e) utilizing said data processing system to execute program instructions of said interfacial severity computer program to apply said input to said interfacial severity computer program and to produce as an output for a particular predefined interval an indicator of potential for abrupt changes in rock strength in said particular wellbore which utilizes at least one of the following types of measures of rock strength:

(1) a measure of relative magnitudes of changes in rock strength over said predefined interval;

(2) a measure of rock strength for each rock forming an interface of differing rocks over said predefined interval; and (3) a measure of frequency of changes of rock strength over said predefined interval.

2. The method of providing an indicator of potential for abrupt changes in rock strength according to claim 1, further comprising:

(f) obtaining empirical wellbore data from said particular wellbore during drilling operations; and (g) additionally supplying said empirical wellbore data as an input to said interfacial severity computer program.

3. The method of providing an indicator of potential for abrupt changes in rock strength according to claim 1, wherein said forensic wellbore data includes at least log data relating to formation strength.

4. The method of providing an indicator of potential for abrupt changes in rock strength according to claim 3, wherein said log data relating to formation strength comprises log data relating to unconfined compressive strength.

5. The method of providing an indicator of potential for abrupt changes in rock strength according to claim 2, wherein said empirical wellbore data comprises at least one of:

(a) unconfined compressive strength;

(b) confined compressive strength;

(c) porosity;

(d) lithologies; and (e) sonic velocities.

6. The method of providing an indicator of potential for abrupt changes in rock strength according to claim 1, wherein said forensic wellbore data includes at least one of:

(a) unconfined compressive strength;

(b) confined compressive strength;

(c) porosity;

(d) lithologies; and (e) sonic velocities.

7. The method of providing an indicator of potential for abrupt changes in rock strength according to claim 1, wherein said indicator of potential for abrupt changes in rock strength comprises a numerical indicator of potential for abrupt changes in rock strength.

8. The method of providing an indicator of potential for abrupt changes in rock strength according to claim 1, wherein said numerical indicator comprises a numerical value in the range between an upper boundary value and a lower boundary value.

9. The method of providing an indicator of potential for abrupt changes in rock strength according to claim 2:

(h) wherein said indicator of potential for abrupt changes in rock strength is generated repeatedly during drilling operations; and (i) wherein said indicator provides an indication of potential for abrupt changes in rock strength before drilling occurs.

10. The method of providing an indicator of potential for abrupt changes in rock strength according to claim 1 further comprising:

(f) altering at least one drilling condition in response to said indicator in order to improve drilling operations.

11. The method of providing an indicator of potential for abrupt changes in rock strength according to claim 10, wherein said at least one drilling condition includes at least one of:

(1) bit type;

(2) rotary speed; and (3) weight on bit.

12. The method of providing an indicator of potential for abrupt changes in rock strength according to claim 11, wherein said interfacial severity computer program establishes correspondence between a plurality of abrupt changes in rock strength and said indicator.

13. The method of providing an indicator of potential for abrupt changes in rock strength according to claim 12, wherein said plurality of measures of rock strength include a plurality of the following:

(a) average unconfined compressive strength;

(b) the root-mean-square value of the unconfined compressive strength;

(c) frequency of change in unconfined compressive strength.

14. An apparatus for providing an indicator of potential for abrupt changes in rock strength in a particular wellbore, comprising:

(a) a data processing system adapted for execution of program instructions;

(b) an interfacial severity computer program composed of executable program instructions, and including:

(1) an input program module for receiving forensic data corresponding to at least one of the following distinct wellbore parameters for a predefined interval:

(a) average unconfined compressive strength;

(b) the root-mean-square value of the unconfined compressive strength;

(c) frequency of change in unconfined compressive strength;

(2) an calculation program module which includes an algorithm which establishes correspondence between said distinct wellbore parameters and an indicator of potential for abrupt changes in rock strength and which combines the effects of at least two of said distinct wellbore parameters utilizing said algorithm in order to produce as an output an indicator of potential for abrupt changes in rock strength.

15. The apparatus for providing an indicator of potential for abrupt changes in rock strength according to claim 14, wherein said interfacial severity computer program further includes:

(3) an output program which provides in a human-readable format said indicator of potential for abrupt changes in rock strength.

16. The apparatus for providing an indicator of potential for abrupt changes in rock strength according to claim 15, wherein said indicator for potential abrupt changes in rock strength is presented in human-readable format of a single numeric value from a range of available numeric values between an upper numeric limit and a lower numeric limit.

17. The apparatus for providing an indicator of potential for abrupt changes in rock strength according to claim 14, wherein said interfacial severity computer program further includes:

(3) program instructions for recursively computing said indicator of potential for abrupt changes in rock strength during drilling operations.

* * * * *